US007008247B2

(12) United States Patent
Anzai

(10) Patent No.: US 7,008,247 B2
(45) Date of Patent: Mar. 7, 2006

(54) JACK HAVING SWITCH

(75) Inventor: Masahiro Anzai, Tokyo (JP)

(73) Assignee: Jalco Co., Ltd., Tokyo (JP)

( * ) Notice: Subject to any disclaimer, the term of this patent is extended or adjusted under 35 U.S.C. 154(b) by 0 days.

(21) Appl. No.: 11/093,045

(22) Filed: Mar. 30, 2005

(65) Prior Publication Data

US 2005/0227523 A1 Oct. 13, 2005

(30) Foreign Application Priority Data

Apr. 12, 2004 (JP) ..... 2004-117219

(51) Int. Cl.
*H01R 29/00* (2006.01)

(52) U.S. Cl. ..... 439/188; 200/51.1

(58) Field of Classification Search ..... 439/188, 439/342, 668, 669; 200/51.1
See application file for complete search history.

(56) References Cited

U.S. PATENT DOCUMENTS 4,633,048 A * 12/1986 Komatsu ..... 200/51.1
4,778,240 A * 10/1988 Komatsu ..... 385/88
5,529,511 A * 6/1996 Matsuoka ..... 439/342
6,830,471 B1 * 12/2004 Okita et al. ..... 439/342

* cited by examiner

*Primary Examiner*—Tulsidas C. Patel
*Assistant Examiner*—Vladimir Imas
(74) *Attorney, Agent, or Firm*—Duane Morris LLP

(57) ABSTRACT

A jack having switch is constituted so that a movable armature is displaced so as to be separated from a fixed armature which contacts with the movable armature by insertion of a plug, the plug and the movable armature are brought into a contact state, and this state is maintained. The movable armature has two-pronged branch portions along a plug insertion/uninsertion direction, and the branch portions have plug contact portions which are expanded to be displaced outward by the plug to be inserted therebetween and hold the outside of the plug so as to be connected to the plug. The branch portions have fixed armature contact portions which contact with the movable armature arranged to be opposed to the branch portions when the plug is not inserted.

17 Claims, 6 Drawing Sheets

JACK HAVING SWITCH

BACKGROUND OF THE INVENTION

1. Field of the Invention

The present invention relates to a jack having switch in which when a movable armature which is in contact with a fixed armature is displaced due to insertion of a plug so as to be separated from the fixed armature, simultaneously the inserted plug is brought into electrically contact with the movable armature.

2. Description of the Related Art

Conventionally, when plugs such as pin plugs are inserted in the field of audio devices and video devices, switches are disconnected, and jacks having switch is connected with the inserted plugs. Such jacks having switch in Japanese Utility Model Application Publications No. 6-16413 (1994) and 3-13988 (1991) (Patent Literature 1 and 2) are publicly known.

Both the publicly-known jacks having switch have the fixed armature and the movable armature in a connected state (closed state) in a cylindrical jack main body. When the plug is inserted, the plug displaces the movable armature so that the movable armature is separated from the fixed armature (opened state). The plug and the movable armature mechanically contact and are electrically connected with each other, so that the inserted plug is connected with the jack. Such a basic function is common between both the jacks, but some jacks have weak power for holding the inserted jack.

In the jacks having weak jack holding power, a direction of the displacement of the movable armature displaced due to the insertion of the plug is displacement of a conductive plate material having spring properties composing the movable armature in a shear direction (a thicknesswise direction of the plate material). For this reason, the plug holding power is weak.

SUMMARY OF THE INVENTION

In order to solve the above problem of the publicly-known jacks having switch, it is an object of the present invention to provide a jack having switch in which a direction of displacement of a movable armature in the jack due to insertion of a plug is prevented from being deflection of a plate material composing the movable armature in its thicknesswise direction, thereby strengthening plug holding power, and since an oxide film of a plug surface can be removed by the strong holding power with respect to the plug to be inserted, a stable electric contact state is always realized.

In order to solve the above problem, a jack having switch of the invention in which a movable armature is displaced so as to be separated from a fixed armature in contact with the movable armature by insertion of a plug, the plug and the movable armature are brought into a contact state and this state is maintained, is characterized by that the movable armature has two-pronged branch portions along a plug insertion/uninsertion direction, the branch portions have plug contact portions, which are expanded to be displaced outward by the plug to be inserted between the branch portions and hold an outside of the plug so as to be connected to the plug, respectively, and the two-pronged branch portions have fixed armature contact portions, which contact with the fixed armature arranged to be opposed to the branch portions when the plug is not inserted, respectively.

The jack of the invention having the above constitution can use the movable armature which is formed by a conductive plate material which is provided with the two-pronged branch portions into an approximately Y shape viewed from a plane or is formed by bending middle portions of the branch portions at approximately 90°.

In the jack of the invention having the above constitution, the plug contact portions which hold the outside of the plug to be inserted so as to contact with the plug are formed on an inner surface opposed to the two-pronged branch portions of the movable armature, and the fixed armature contact portions which hold the outside of the fixed armature so as to contact with the fixed armature are formed to be protruded into an approximately convex shape on forward ends of the two-pronged branch portions of the movable armature, respectively. It is preferable that the fixed armature arranged to be opposed to the convex-shaped fixed armature contact portions has an approximately concave portion which are formed with portions to be contacted on its both sides held by the convex portion.

The jack having switch of the invention is constituted so that the movable armature has the two-pronged branch portions along the plug insertion/uninsertion direction, the branch portions are expanded to be displaced outward by the plug to be inserted therebetween and hold the outside of the plug, and the two-pronged branch portions have the fixed armature contact portions which contact with the fixed armature arranged to be opposed to the branch portions when the plug is not inserted. For this reason, strong plug holding power can be produced, and thus an oxide film on the plug surface can be removed securely at every time of the insertion/uninsertion of the plug into/from the jack. As a result, stability of electric contact can be obtained. Further, since the fixed armature and the movable armature at the time when the plug is not inserted are maintained in the contact state by contact power caused by the two-pronged branch portions of the movable armature, contact strength is hardly deteriorated.

DETAILED DESCRIPTION OF THE PREFERRED EMBODIMENT

Figure 1:
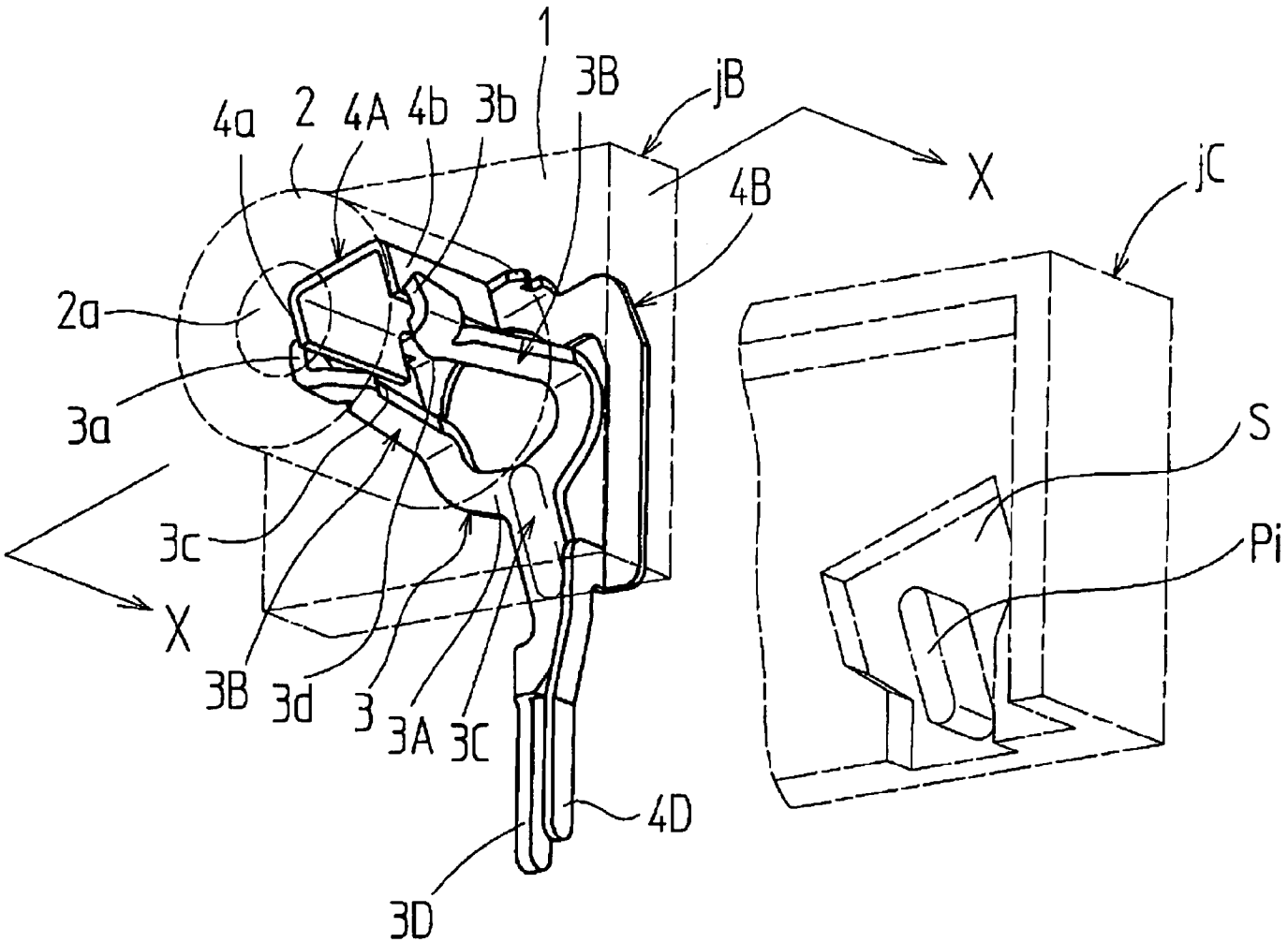
FIG. 1 is a perspective view from a front side for explaining a relationship between a movable armature and a fixed armature in a jack having switch of the present invention.
Figure 2:
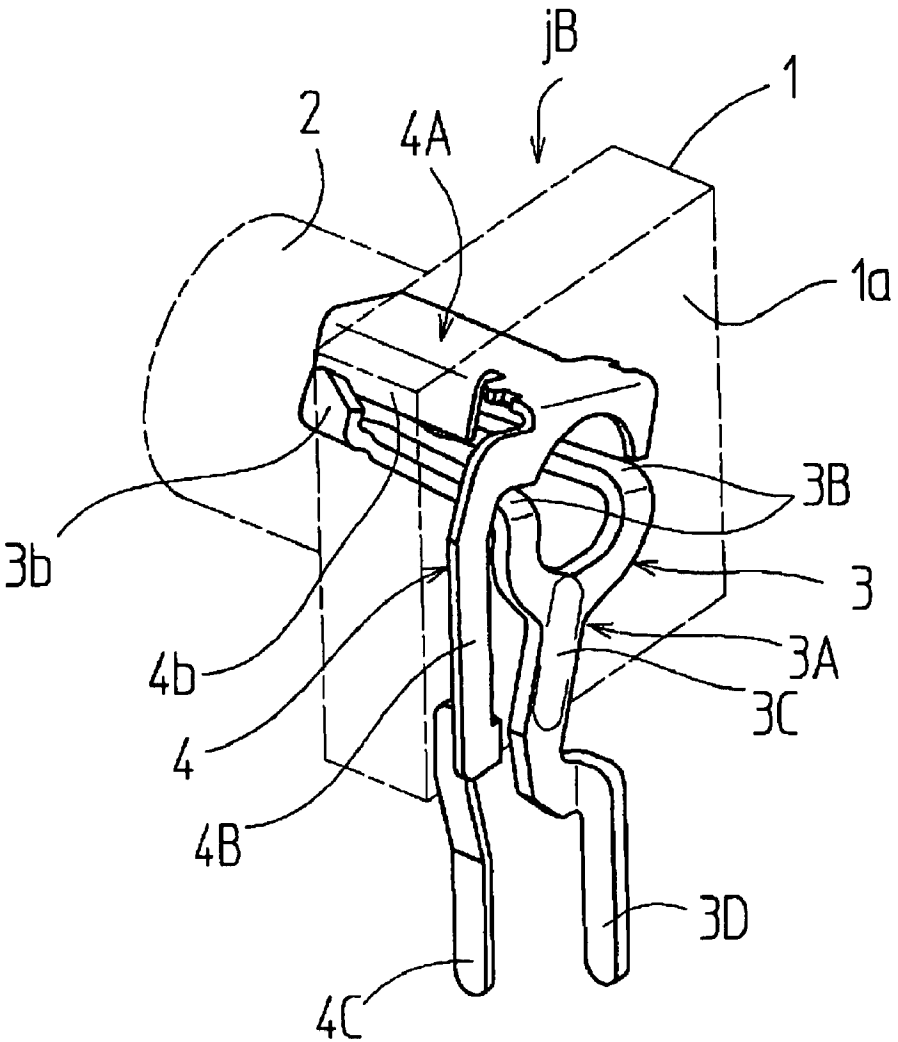
FIG. 2 is a perspective view from a rear side in FIG. 1.
Figure 3:
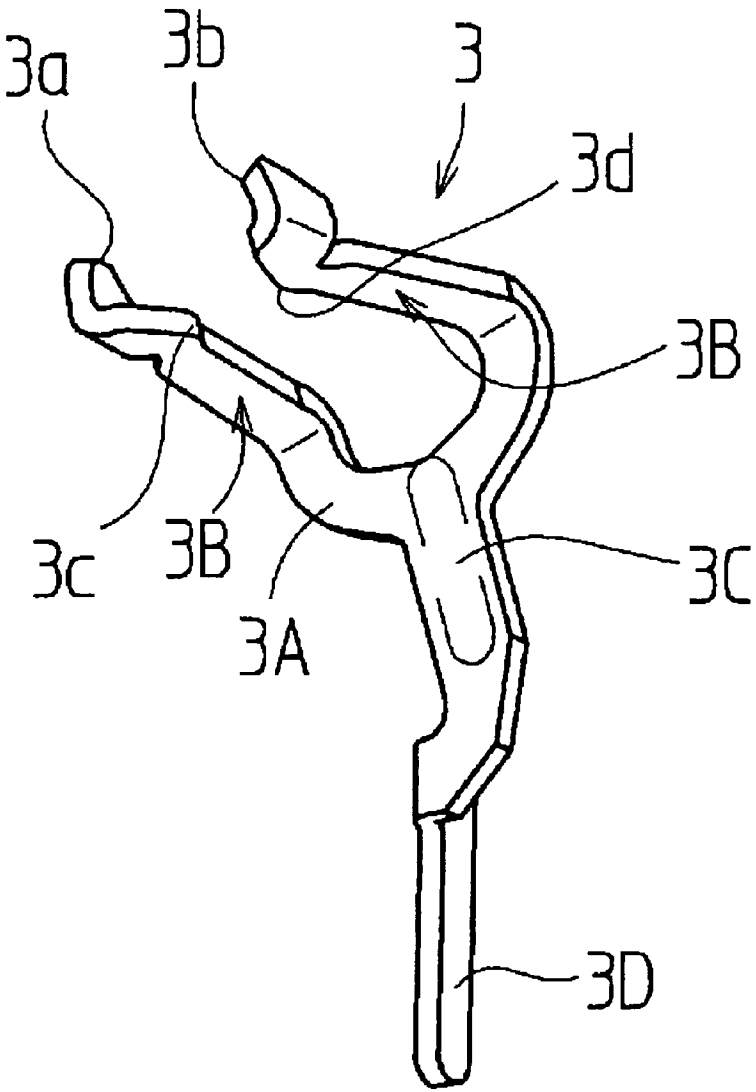
FIG. 3 is a perspective view of the movable armature in the jack of the invention of FIGS. 1 and 2.
Figure 4:
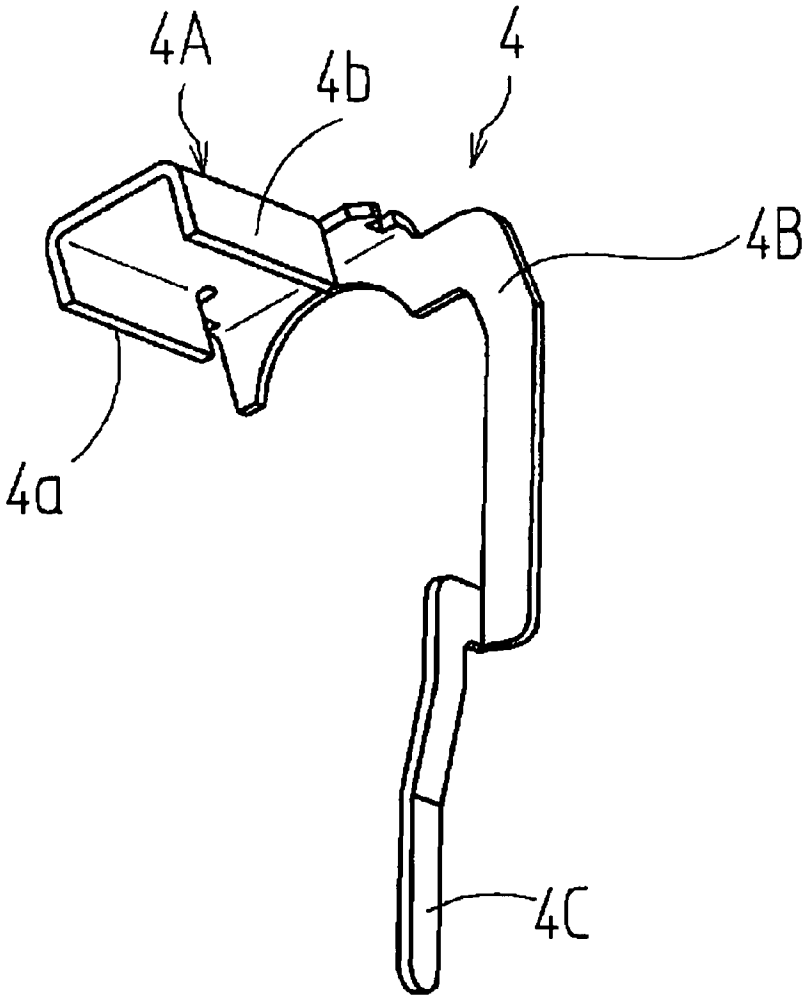
FIG. 4 is a perspective view of the movable armature in the jack of the invention of FIGS. 1 and 2.
Figure 5:
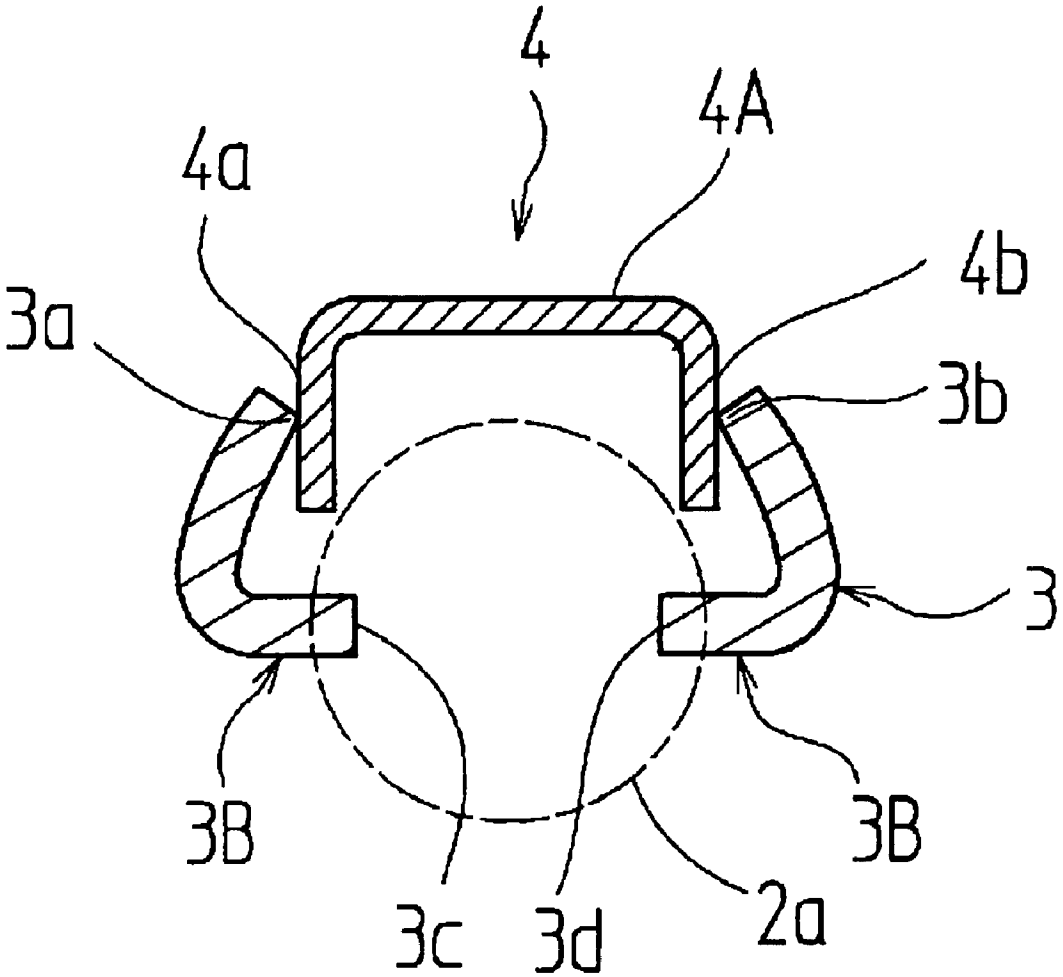
FIG. 5 is an enlarged end view taken along line X—X of FIG. 1.
Figure 6:
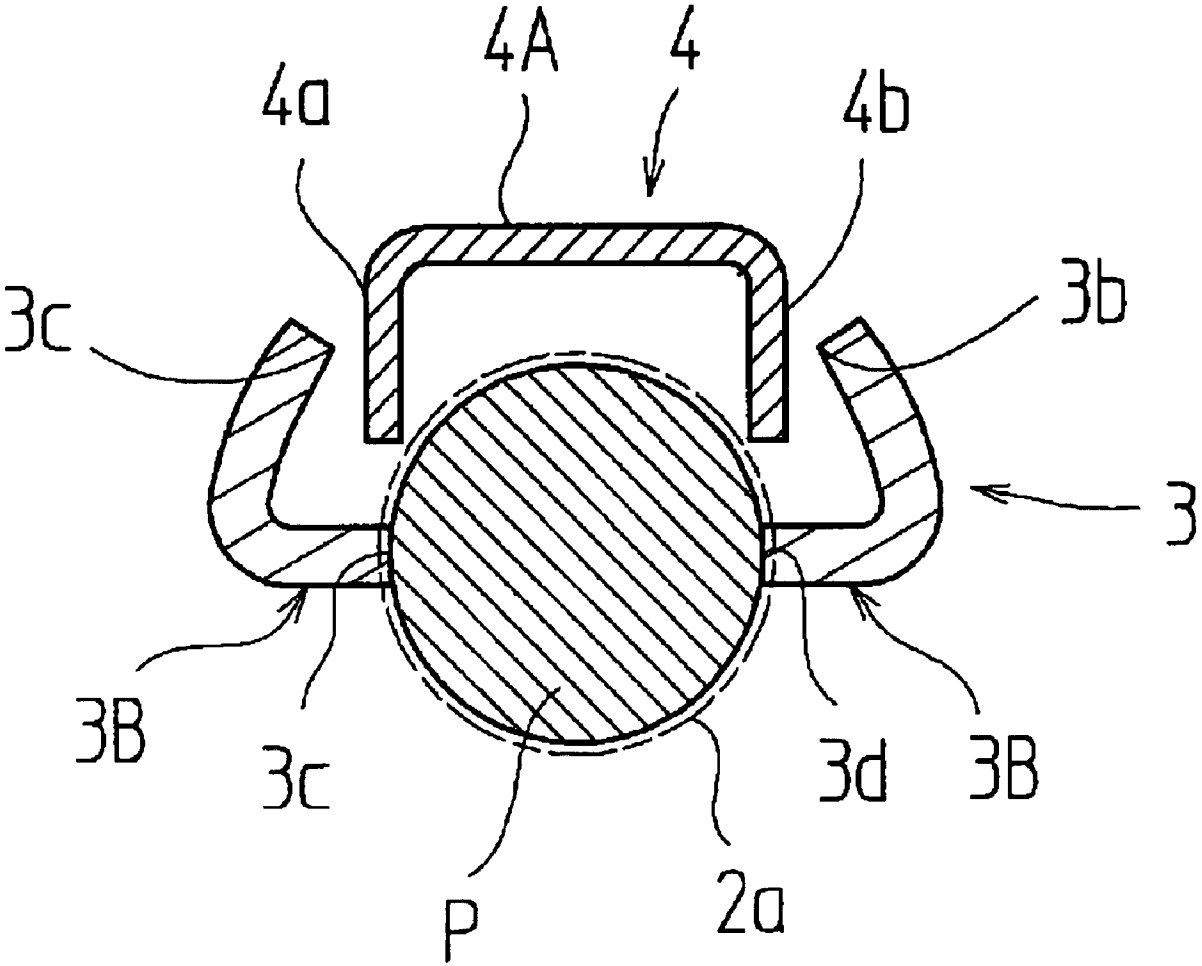
FIG. 6 is an end view in the state that a plug is inserted into the jack of the invention in the state of FIG. 5.

A jack according to an embodiment of the present invention is explained below with reference to the drawings. FIG. 1 is a perspective view from a front side for explaining a relationship between a movable armature and a fixed armature in the jack having switch of the invention, and FIG. 2 is a perspective view from a rear side of FIG. 1. FIG. 3 is a perspective view of the movable armature in the jack of the invention in FIGS. 1 and 2, and FIG. 4 is a perspective view of the fixed armature in the jack of the invention in FIGS. 1 and 2. FIG. 5 is an enlarged end view taken along line X—X of FIG. 1, and FIG. 6 is an end view in a state that a plug is inserted into the jack of the invention in the state of FIG. 5.

In FIGS. 1 and 2, the jack having switch of the invention is constituted so that a jack body jB, which is composed of a main body 1 formed by a nonconductor such as plastic and a cylindrical protrusion 2 formed integrally with a front side of the main body 1, is provided with a movable armature 3 and a fixed armature 4 explained later. This basic constitution is equivalent to that of the publicly-known jacks.

A rear surface 1*a* of the main body 1 is connected with a cylinder inside 2*a* of the cylindrical protrusion 2, and the movable armature 3 and the fixed armature 4 are inserted into the cylinder inside 2*a* through the rear surface 1*a* of the main body 1. The cylinder inside 2*a* is exposed as a connected point with the plug in to which plug contact portions 3*c* and 3*d* (mentioned later) of the movable armature 3 are inserted so that a plug insertion hole is formed.

In the jack of the invention, a conductive plate material is punched by a press or the like into an approximately Y shape viewed from a plane so that a main body 3A of the movable armature 3 is formed. The left and right fixed armature contact portions 3*a* and 3*b* which rise upward or into an approximately convex shape are formed on forward ends of two branch portions 3B (left in the drawing) branched from a branch portion 3C. Front sides (forward ends) of the two-pronged branch portions 3B and 3B are drawn to the inner side (approaching side), and the inner surfaces of the forward ends are slightly sharpened so that plug contact portions 3*c* and 3*d* are formed.

In the example shown in the drawing, the middle portions of the two-pronged branch portions 3B of the movable armature 3 which are close to the branch portion 3C are bent at approximately 90° downward , but in the jack of the invention, the movable armature 3 is of a flat type where the main body 3A of movable armature is positioned on the same plane as that of the branch portions 3B. In both the 90° bending-type movable armature 3 and the flat type movable armature 3, the two-pronged branch portions 3B face in approximately parallel with the cylinder inside 2*a*. For this reason, the branch portions 3B are approximately parallel with a plug P (see FIG. 6) to be inserted/uninserted into/from the cylinder inside 2*a*.

When, therefore, the plug P is inserted into the cylinder inside 2*a*, the plug contact portions 3*c* and 3*d* are pushed by an outer peripheral surface of the plug P to be inserted, so that the two-pronged branch protons 3B displace so as to spread outward. This displacement means that the displacement (deformation) of the movable armature 3 due to insertion/uninsertion of the plug P occurs not in the shear direction (thicknesswise direction) of the plate material forming the movable armature 3 but in a right-left widthwise direction of the plate material.

The displacement of the plug contact portions 3*c* and 3*d* due to the insertion/uninsertion of the plug P is not deflection in the shear direction of the armature plate material of the conventional jack. For this reason, the power for holding the inserted plug becomes strong, and the oxide film on the plug surface can be removed securely. As a result, the movable armature 3 of the jack according to the invention can obtain stability of the electric contact.

The 90° bending type movable armature 3 in the drawing is effective for the case where the jack body jB is thinned. That is to say, in order to thin the jack body jB, the lengths of the two-pronged branch portions 3B of the movable armature 3 should be shortened, but when they are shortened, it is difficult to obtain the spring properties. In the switch constitution of the present invention, therefore, the middle portions of the two-pronged branch portions 3B of the movable armature 3 are bent at approximately 90°. The branch portion 3C positioned near the boundary divided by one portion of the movable armature main body 3A and the two-pronged branch portions 3B is pushed against the jack body jB by a convex portion Pi as a pushing portion formed on the front surface of a body rear cover jC attached to the rear surface of the jack body jB. Further, a space S which is necessary for the displacement of the movable armature 3 is formed around the convex portion Pi. In such a manner, the branch portion 3C of movable armature 3 is fixed to the rear surface of the jack body jB by the convex portion Pi of the body rear cover jC, and the space S is formed around the convex portion Pi. As a result, in the movable armature 3, a displacement freedom is secured between the 90° bent portions of the two-pronged branch portions 3B and the branch portion 3C of the movable armature 3 with the branch portion 3C of the main body 3A being used as a supporting point.

According to the above constitution, the inserted plug expands and displaces the two-pronged branch portions 3B and the plug contact portions 3*c* and 3*d* to the plate widthwise direction, and according to this displacement, the fixed armature contact portions 3*a* and 3*b* are expanded to be displaced. This displacement, however, occurs in the plate thicknesswise direction (torsion direction of the plate material) because its direction is changed between the 90° bending portions of the two-pronged branch portions 3B and the branch portion 3C of the main body 3A of the movable armature 3. For this reason, the spring properties can be easily obtained, and the plug holding power which is equivalent to that of the flat type movable armature 3 which is not bent at 90° can be obtained. Further, the jack body jB can be thinned.

The fixed armature 4 which is installed into the cylindrical protrusion 2 of the body jB so as to be opposed to the movable armature 3 has the following constitution.

That is to say, the movable armature 3 illustrated in the drawing is arranged so that the two-pronged branch portions 3B are positioned on a diameter of the cylinder inside 2*a* in the cylindrical protrusion 2 of the body jB in an approximately horizontal direction (the branch portions 3B are positioned on the diameter of the cylinder inside 2*a*, but its direction is not limited to the horizontal direction) . For this reason, the illustrated fixed armature 4 is formed by a concave portion 4A which is concave downward and a base portion 4B. The concave portion 4A has upright wall type portions 4*a* and 4*b* to be contacted on its left and right portions and are opposed to the fixed armature contact portions 3*a* and 3*b* which are positioned on the left and right portions on the upper surface of the front end of the movable armature 3, respectively. The base portion 4B is continuous integrally with the concave portion 4A.

When the plug P is not inserted, the portions 4*a* and 4*b* to be contacted of the fixed armature 4 are held between the left and right fixed armature contact portions 3*a* and 3*b* of the movable armature 3, and the related contact portion 3*a* and portion 4*a* to be contacted, and the related contact portion 3*b* and the portion 4*b* to be contacted are forcibly brought into contact with each other respectively by the function of the two-pronged branch portions 3B tapered inward (see FIGS. 1, 2 and 5). Connecting legs 3D and 4C to be connected to a plated circuit or the like are formed on lower portions of the main body 3A of the movable armature 3 and the base portion 4B of the fixed armature 4, respectively, so as not to be short-circuited.

As shown in FIGS. 1, 2 and 5, in the state that the plug P is not inserted into the jack of the invention, as to the movable armature 3 and the fixed armature 4, the contact portion 3*a* and the portion 4*a* to be contacted, and the contact portion 3*b* and the portion 4*b* to be contacted are maintained in the contact state by the holding power of the fixed armature contact portions 3*a* and 3*b*. In this state, when the plug P is inserted into the cylinder inside 2*a* of the jack body jB, the plug contact portions 3*c* and 3*d* are positioned on the diameter of the plug P. For this reason, both the plug contact portions 3*c* and 3*d* are expanded outward to the left and right directions by an outer diameter of the plug P integrally with the two-pronged branch portions 3B, and also the fixed armature contact portions 3*a* and 3*b* are expanded outward. As a result, in the plug uninserted state in FIG. 5, the fixed armature contact portions 3*a* and 3*b* of the movable armature 3 and the portions 4*a* and 4*b* to be contacted of the fixed armature 4 which are maintained in the forcible contact state are separated from each other as shown in FIG. 6. The conductive state is cut off. When the plug P is disconnected in the state of FIG. 6, the state is returned to the state of FIG. 5.

In the above explanation, the fixed armature contact portions 3*a* and 3*b* and the plug contact portions 3*c* and 3*d* of the movable armature 3 are formed on both the ends of the two-pronged branch portions 3B. In the invention, however, one of the two contact portions 3*a* and 3*b* and one of the contact portions 3*c* and 3*d* are occasionally formed only on the end of any one of the branch portions 3B.

In the above-mentioned invention, the jack having switch is constituted so that the movable armature is displaced by the insertion of the plug so as to be separated from the fixed armature which contacts with the movable armature, and the plug and the movable armature are brought into the contact state, and this sate is maintained. The movable armature has the two-pronged branch portions along the plug insertion/uninsertion direction, and the branch portions have the plug contact portions which are expanded and displaced outward by the plug to be inserted therebetween and hold the outside of the plug so as to be connected to the plug. The two-pronged branch portions have the fixed armature contact portions which contact with the fixed armature opposed to the branch portions when the plug is not inserted. For this reason, the displacement of the movable armature due to the insertion/uninsertion of the plug becomes displacement in the widthwise direction of the plate material, and the jack having switch whose holding power is stronger than the holding and contact of the plug due to the displacement in the shear direction of the plate material can be provided.

The jack of the invention has the strong plug holding power, and further the contact portion with the plug outer peripheral surface is a small surface (cut surface) of the plate material forming the movable armature. For this reason, the oxide film on the plug surface can be removed effectively, there by obtaining the high stability of the electric contact between the plug and the jack.

What is claimed is:

1. A jack having switch in which a movable armature is displaced so as to be separated from a fixed armature in contact with the movable armature by insertion of a plug, the plug and the movable armature are brought into a contact state and this state is maintained, wherein the movable armature has two-pronged branch portions along a plug insertion/uninsertion direction, the branch portions have plug contact portions, which contact the plug on opposites of the plug and are expanded to be displaced in opposite directions by insertion of the plug, the two-pronged branch portions have fixed armature contact portions which are displaced in opposite directions thereby separating the movable armature from the fixed armature when the plug is inserted.

2. The jack having switch according to claim 1, wherein the movable armature is formed by a conductive plate material which is provided with the two-pronged branch portions into an approximately Y shape viewed from a plane or is formed by bending middle portions of the branch portions at approximately 90°.

3. The jack having switch according to claim 1, wherein the plug contact portions which hold the outside of the plug to be inserted so as to contact with the plug are formed on an opposing inner surfaces of the two-pronged branch portions of the movable armature.

4. The jack having switch according to claim 1, wherein the fixed armature contact portions of the movable armature which hold the outside of the fixed armature so as to contact with the fixed armature are formed to be protruded into an approximately convex shape on forward ends of the two-pronged branch portions of the movable armature.

5. The jack having switch according to claim 4, wherein the fixed armature has an approximately concave portion which is contacted on its outer sides by the convex-shaped fixed armature contact portions of the movable armature.

6. The jack having switch according to claim 1, wherein the movable armature is constituted so that the branch portions are fixed to a body rear surface by a retaining portion formed on a body rear cover.

7. The jack having switch according to claim 2, wherein the plug contact portions which hold the outside of the plug to be inserted so as to contact with the plug are formed on an opposing inner surfaces of the two-pronged branch portions of the movable armature.

8. The jack having switch according to claim 2, wherein the fixed armature contact portions of the movable armature which hold the outside of the fixed armature so as to contact with the fixed armature are formed to be protruded into an approximately convex shape on forward ends of the two-pronged branch portions of the movable armature.

9. The jack having switch according to claim 3, wherein the fixed armature contact portions of the movable armature which hold the outside of the fixed armature so as to contact with the fixed armature are formed to be protruded into an approximately convex shape on forward ends of the two-pronged branch portions of the movable armature.

10. The jack having switch according to claim 7, wherein the fixed armature contact portions of the movable armature which hold the outside of the fixed armature so as to contact with the fixed armature are formed to be protruded into an approximately convex shape on forward ends of the two-pronged branch portions of the movable armature.

11. The jack having switch according to claim 8, wherein the fixed armature has an approximately concave portion which is contacted on its outer sides by the convex-shaped fixed armature contact portions of the movable armature.

12. The jack having switch according to claim 9, wherein the fixed armature has an approximately concave portion which is contacted on its outer sides by the convex-shaped fixed armature contact portions of the movable armature.

13. The jack having switch according to claim 10, wherein the fixed armature has an approximately concave portion which is contacted on its outer sides by the convex-shaped fixed armature contact portions of the movable armature.

14. The jack having switch according to claim 2, wherein the movable armature is constituted so that the branch portions are fixed to a body rear surface by a retaining portion formed on a body rear cover.

15. The jack having switch according to claim 3, wherein the movable armature is constituted so that the branch portions are fixed to a body rear surface by a retaining portion formed on a body rear cover.

16. The jack having switch according to claim 4, wherein the movable armature is constituted so that the branch portions are fixed to a body rear surface by a retaining portion formed on a body rear cover.

17. The jack having switch according to claim 5, wherein the movable armature is constituted so that the branch portions are fixed to a body rear surface by a retaining portion formed on a body rear cover.

* * * * *